US008316465B1

(12) United States Patent
Jenney

(10) Patent No.: US 8,316,465 B1
(45) Date of Patent: Nov. 27, 2012

(54) APPAREL SYSTEM

(76) Inventor: Neil Jenney, New York, NY (US)

( * ) Notice: Subject to any disclaimer, the term of this patent is extended or adjusted under 35 U.S.C. 154(b) by 393 days.

(21) Appl. No.: 12/584,114

(22) Filed: Aug. 31, 2009

(51) Int. Cl.
*A41D 13/02* (2006.01)
*A41D 1/04* (2006.01)

(52) U.S. Cl. ..... 2/79; 2/102

(58) Field of Classification Search ..... 2/70, 71, 2/72, 75, 79, 80, 95, 102, 103, 227, 229, 2/230; D2/829, 830, 743
See application file for complete search history.

(56) References Cited

U.S. PATENT DOCUMENTS

| | | | | | |
|---|---|---|---|---|---|
| 471,789 | A | * | 3/1892 | Fitz | 2/102 |
| 758,892 | A | * | 5/1904 | Bewsic | 2/102 |
| 888,059 | A | * | 5/1908 | Bewsic | 2/102 |
| 900,050 | A | * | 9/1908 | Wise | 2/79 |
| 965,596 | A | * | 7/1910 | Pell | 2/230 |
| 1,007,969 | A | * | 11/1911 | Pell | 2/79 |
| 1,218,941 | A | * | 3/1917 | Hodes | 2/102 |
| 1,229,484 | A | * | 6/1917 | Lindenthal | 2/102 |
| 1,243,828 | A | * | 10/1917 | Freedman | 2/102 |
| 1,267,944 | A | * | 5/1918 | Webb | 2/72 |
| D52,115 | S | * | 6/1918 | Pisarro | D2/743 |
| 1,322,527 | A | * | 11/1919 | Brenk | 2/102 |
| 1,411,119 | A | * | 3/1922 | Metcalf | 2/79 |
| 1,441,622 | A | * | 1/1923 | Bernstein | 2/79 |
| 1,505,053 | A | * | 8/1924 | Millhauser | 2/90 |
| 1,590,843 | A | | 6/1925 | Mahan | |
| 1,659,451 | A | * | 2/1928 | Sweeney | 2/79 |
| 1,664,512 | A | * | 4/1928 | Johnson | 2/79 |
| 1,716,061 | A | * | 6/1929 | Janke | 2/96 |
| 1,726,951 | A | * | 9/1929 | Evanove | 2/227 |
| 1,789,784 | A | * | 1/1931 | Sneider | 2/227 |
| D87,017 | S | * | 5/1932 | Morand | D2/743 |
| 2,016,897 | A | * | 10/1935 | Garrett et al. | 2/227 |
| 2,084,208 | A | | 7/1936 | Lucas | |
| D101,779 | S | * | 11/1936 | Kratz | D2/743 |
| 2,087,246 | A | * | 7/1937 | Edwards | 2/79 |
| 2,355,193 | A | * | 8/1944 | Walker | 2/79 |
| 2,412,522 | A | * | 12/1946 | Lehman | 2/79 |
| 2,579,383 | A | | 7/1949 | Goudsmit | |
| 2,562,234 | A | * | 7/1951 | Gottschalk | 2/117 |
| 2,641,764 | A | * | 6/1953 | Fischer | 2/70 |
| 3,085,250 | A | * | 4/1963 | Finlay | 2/102 |
| 4,549,315 | A | | 10/1985 | English | |
| D298,380 | S | * | 11/1988 | Clutts, Sr. | D2/743 |
| D300,384 | S | * | 3/1989 | Yasuda | D2/743 |
| D306,230 | S | | 2/1990 | Nigro | |
| 5,033,117 | A | * | 7/1991 | Fairweather | 2/69 |
| 5,195,187 | A | * | 3/1993 | Yang | 2/102 |
| 5,267,352 | A | * | 12/1993 | Rodarmel | 2/44 |
| 5,359,731 | A | * | 11/1994 | Cavalier | 2/46 |

(Continued)

*Primary Examiner* — Alissa L Hoey

(57) ABSTRACT

An overall has upper, lower and intermediate sections. The upper section includes a bib front with utility pockets and V-shaped upper edges terminating with front buttons which allows the upper section of the overall to disappear when wearing a vest. The upper section has a back with V-shaped upper edges. The upper section has straps positionable between the front and back extending over shoulders of a wearer. The straps include slide buckles and are formed with narrow widths as extensions of the back rearwardly and with hooks forwardly adapted to separably couple with the front buttons for forming lateral arm openings for arms of a wearer and for facilitating the donning and removal of the overall. The lateral arm openings include selectively engageable side buttons with associated button holes for facilitating the donning and removal of the overall. The overall includes a generally horizontal plane between the intermediate section and the arm openings with the bight of the overall being closer to the horizontal plane than to the upper edge of the back.

1 Claim, 2 Drawing Sheets

U.S. PATENT DOCUMENTS 5,611,082 A 3/1997 Bull
5,742,940 A * 4/1998 Sparks ..... 2/79
D400,689 S * 11/1998 Engling ..... D2/743
5,884,332 A * 3/1999 Snedeker ..... 2/97
5,907,869 A * 6/1999 Bohn et al. ..... 2/102
5,940,883 A * 8/1999 Daoust ..... 2/102
6,119,269 A * 9/2000 Imler et al. ..... 2/94
D440,379 S * 4/2001 Breier ..... D2/743
D468,077 S * 1/2003 LaPeau ..... D2/743
D505,772 S * 6/2005 Helbing et al. ..... D2/743
7,181,774 B2 * 2/2007 Silver ..... 2/227
D538,008 S * 3/2007 Helbing et al. ..... D2/743

* cited by examiner

APPAREL SYSTEM

BACKGROUND OF THE INVENTION

1. Field of the Invention

The present invention relates to an apparel system and more particularly pertains to overalls adapted to be worn beneath a covering garment.

2. Description of the Prior Art

The use of apparel systems of known designs and configurations is known in the prior art. More specifically, apparel systems of known designs and configurations previously devised and utilized for the purpose of wearing apparel through known methods and apparatuses are known to consist basically of familiar, expected, and obvious structural configurations, notwithstanding the myriad of designs encompassed by the crowded prior art which has been developed for the fulfillment of countless objectives and requirements. By way of example, U.S. Pat. No. 4,549,315 issued Oct. 29, 1958 to English relates to a Fireman's Bin Overall. U.S. Pat. No. 5,611,082 issued Mar. 18, 1997, to Bull relates to a Thermally Insulated Garment with Displaceable Feet Enclosing Sections. U.S. Pat. No. Des. 306,230 issued Feb. 27, 1990 to Nigro relates to a Shirt. U.S. Pat. No. 2,579,383 issued Jul. 8, 1949, to Goudsmit relates to an Electrically Heated Vest. U.S. Pat. No. 2,084,208 issued Jul. 8, 1936, to Lucas relates to Overalls. Lastly, U.S. Pat. No. 1,590,843 issued Jun. 8, 1925, to Mahan relates to Overalls.

While these devices fulfill their respective, particular objectives and requirements, the aforementioned patents do not describe an apparel system that allows for wearing beneath a covering vest in a convenient and attractive manner.

In this respect, the apparel system according to the present invention substantially departs from the conventional concepts and designs of the prior art, and in doing so provides an apparatus primarily developed for the purpose of wearing beneath a covering vest in a convenient and attractive manner.

Therefore, it can be appreciated that there exists a continuing need for a new and improved apparel system which can be used for wearing beneath a covering vest in a convenient and attractive manner. In this regard, the present invention substantially fulfills this need.

SUMMARY OF THE INVENTION

In view of the foregoing disadvantages inherent in the known types of apparel systems of known designs and configurations now present in the prior art, the present invention provides an improved apparel system. As such, the general purpose of the present invention, which will be described subsequently in greater detail, is to provide a new and improved apparel system and method which has all the advantages of the prior art and none of the disadvantages.

To attain this, the present invention essentially comprises an apparel system. First provided is an overall. The overall has a front. The overall has a back. The overall has sides. The sides are provided between the front and the back. The overall has an upper section. The overall has a lower section. The overall has an intermediate section. The intermediate section is provided between the upper and lower sections.

The upper section includes a bib front. The bib front has utility pockets. The bib front has V-shaped upper edges. The bib front terminates with front buttons. The upper section has a back. The back has V-shaped upper edges. The upper section has straps. The straps are positionable between the front and back. The straps extend over the shoulders of the wearer. The straps include slide buckles. The straps are formed with narrow widths as extensions of the back rearwardly. The straps have hooks. The hooks are provided forwardly. The hooks are adapted to separably couple with the front buttons. In this manner lateral arm openings are formed for the arms of a wearer. Further in this manner the donning and removal of the overall is facilitated. The lateral arm openings include selectively engageable side buttons. Associated button holes are provided. In this manner the donning and removal of the overall is facilitated.

The lower section includes two laterally spaced leg parts. The leg parts are provided below. The lower section includes a hips part. The hips part is provided above. The hip section has pockets.

The intermediate section includes a lower end. The lower end is formed as an integral extension of the lower section. The intermediate section includes an upper end. The upper end is integrally formed as an extension of the upper section. The intermediate section has side slits. The side slits are formed as continuations of the lateral arm openings of the upper section. The upper edges of the upper section include a central bight. The central bight is located closer to the intermediate section than to the upper edge of the back. The upper edges extend upwardly. The upper edges define an angle of 90 degrees plus or minus 10 percent. The system includes a generally horizontal plane between the intermediate section and the arm openings.

Provided last is a vest. The vest is worn over the upper section of the overall. The vest hides the upper section of the overall. The vest includes a front. The vest includes generally V-shaped upper edges. The vest includes selectively engageable buttons. The vest includes associated button holes. In this manner an opening is defined. Further in this manner the donning and removal of the vest is facilitated. The vest has a back. The vest has a U-shaped upper edge. The vest has straps. The straps are positionable over the shoulders of a wearer. The straps are formed with wide widths as extensions of the back rearwardly and as extensions of the front forwardly. The straps of the vest are between 30 percent and 100 percent wider than the straps of the overall at their highest regions. The vest are sized to cover the entire upper section of the overall and a portion of the intermediate section of the overall with the width of the straps of the vest entirely covering the straps of the overall. The vest extends downwardly to be located entirely below the horizontal plane. The bight of the overall is closer to the horizontal plane than to the upper edge of the back.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparel system which has all of the advantages of the prior art apparel systems of known designs and configurations and none of the disadvantages.

It is another object of the present invention to provide a new and improved apparel system which may be easily and efficiently manufactured and marketed.

It is further object of the present invention to provide a new and improved apparel system which is of durable and reliable constructions.

An even further object of the present invention is to provide a new and improved apparel system which is susceptible of a low cost of manufacture with regard to both materials and labor, and which accordingly is then susceptible of low prices of sale to the consuming public, thereby making such apparel system economically available to the buying public.

Even still another object of the present invention is to provide an apparel system for wearing beneath a covering vest in a convenient and attractive manner.

Lastly, it is an object of the present invention to provide a new and improved apparel system. An overall has upper, lower and intermediate sections. The upper section includes a bib front with utility pockets and V-shaped upper edges terminating with front buttons. The upper section has a back with V-shaped upper edges. The upper section has straps positionable between the front and back extending over shoulders of a wearer. The straps include slide buckles and are formed with narrow widths as extensions of the back rearwardly and with hooks forwardly adapted to separably couple with the front buttons for forming lateral arm openings for arms of a wearer and for facilitating the donning and removal of the overall. The lateral arm openings include selectively engageable side buttons with associated button holes for facilitating the donning and removal of the overall. The overall includes a generally horizontal plane between the intermediate section and the arm openings with the bight of the overall being closer to the horizontal plane than to the upper edge of the back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
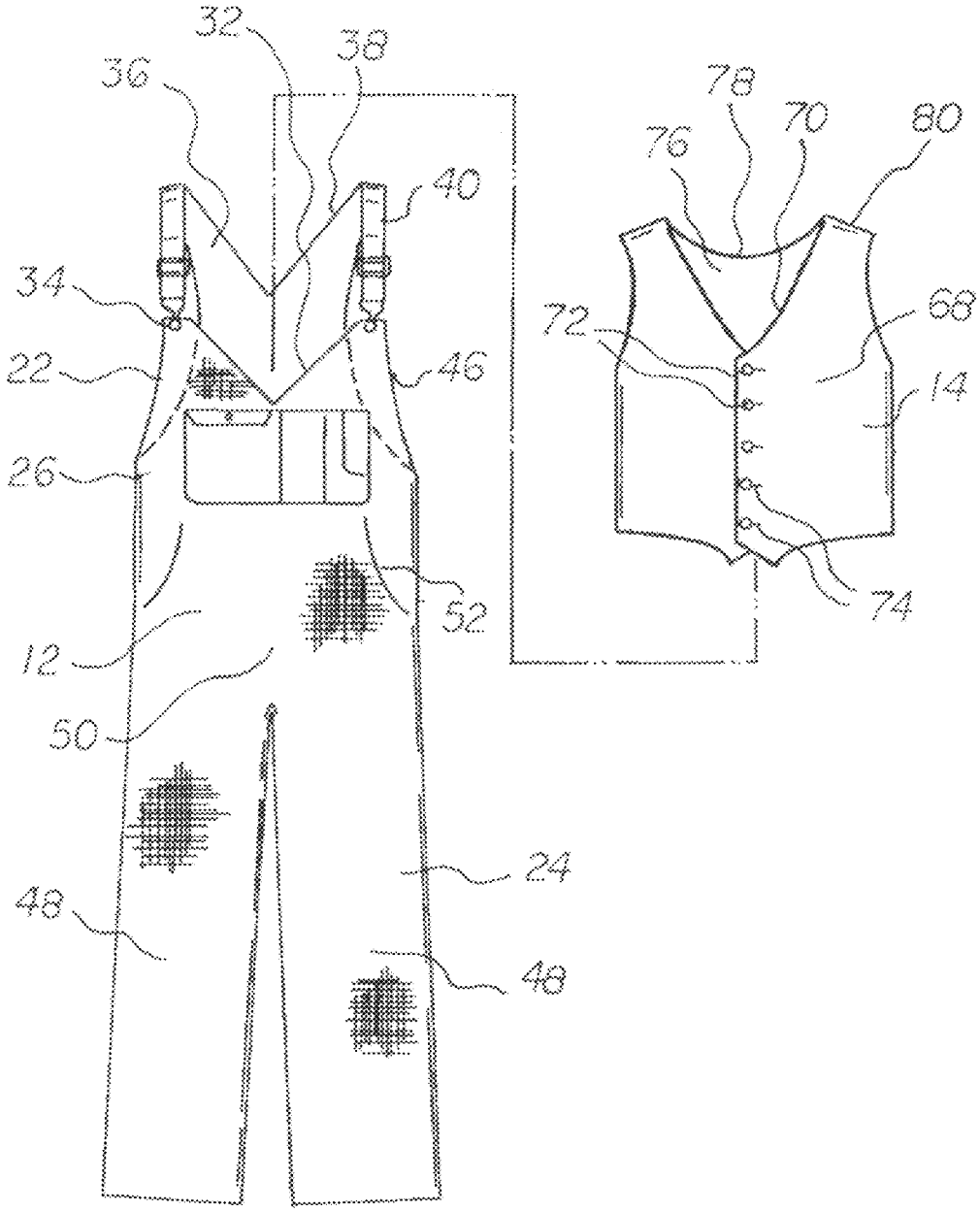
FIG. 1 is an exploded front elevational view of an apparel system constructed in accordance with the principles of the present invention.
Figure 2:
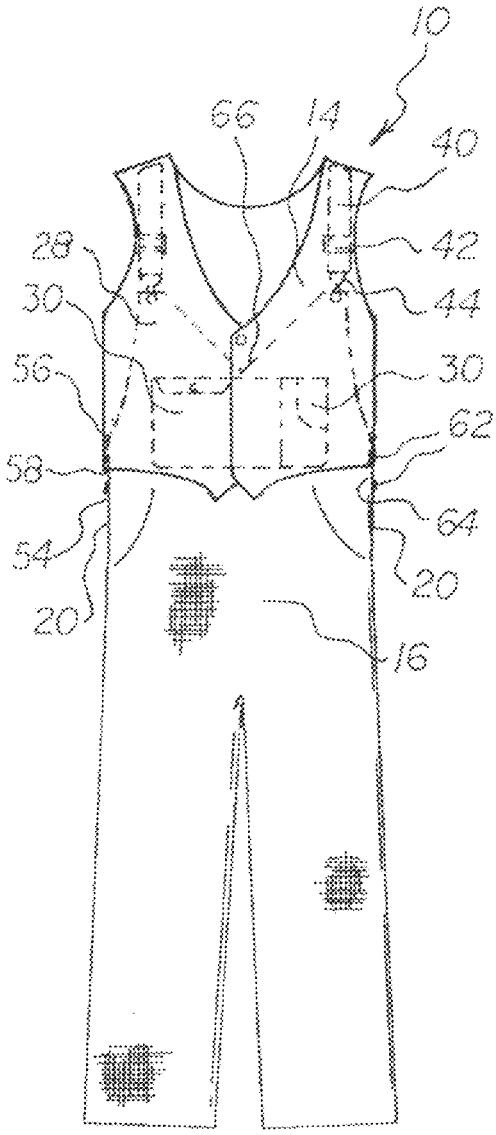
FIG. 2 is a front elevational view of the apparel system of the present invention showing the vest of the system worn over the overall.
Figure 3:
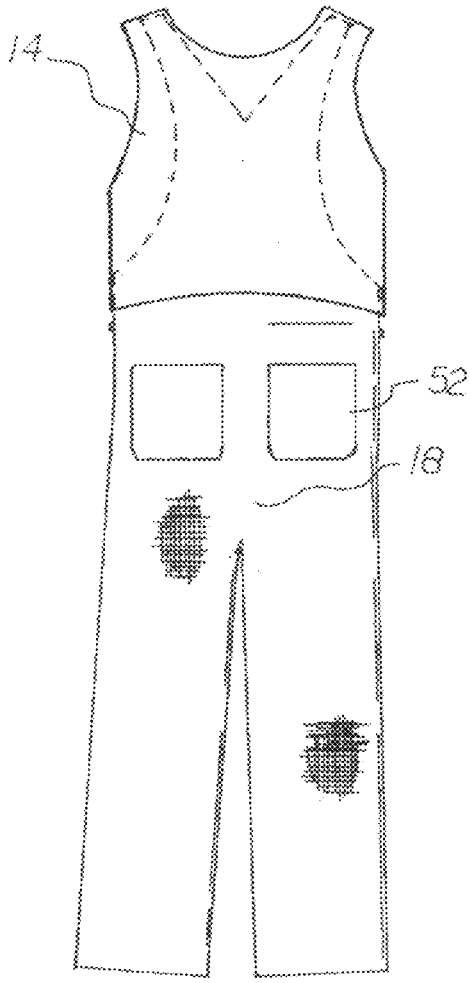
FIG. 3 is a rear elevational view of the apparel system of the present invention.

With reference now to the drawings, and in particular to FIG. 1 thereof, the preferred embodiment of the new and improved apparel system embodying the principles and concepts of the present invention and generally designated by the reference numeral 10 will be described.

The present invention, the apparel system 10 is comprised of a plurality of components. Such components in their broadest context include an overall and a vest. Such components are individually configured and correlated with respect to each other so as to attain the desired objective.

First provided is an overall 12. The overall has a front 16. The overall has a back 18. The overall has sides 20. The sides are provided between the front and the back. The overall has an upper section 22. The overall has a lower section 24. The overall has an intermediate section 26. The intermediate section is provided between the upper and lower sections.

The upper section includes a bib front 28. The bib front has utility pockets 30. The bib front has V-shaped upper edges 32. The bib front terminates with front buttons 34. The upper section has a back 36. The back has V-shaped upper edges 38. The upper section has straps 40. The straps are positionable between the front and back. The straps extend over the shoulders of the wearer. The straps include slide buckles 42. The straps are formed with narrow widths as extensions of the back rearwardly. The straps have hooks 44. The hooks are provided forwardly. The hooks are adapted to separably couple with the front buttons. In this manner lateral arm openings 46 are formed for the arms of a wearer. Further in this manner the donning and removal of the overall is facilitated. The lateral arm openings include selectively engageable side buttons 62. Associated button holes 64 are provided. In this manner the donning and removal of the overall is facilitated.

The lower section includes two laterally spaced leg parts 48. The leg parts are provided below. The lower section includes a hips part 50. The hips part is provided above. The hip section has pockets 52.

The intermediate section includes a lower end 54. The lower end is formed as an integral extension of the lower section. The intermediate section includes an upper end 56. The upper end is integrally formed as an extension of the upper section. The intermediate section has side slits 58. The side slits are formed as continuations of the lateral arm openings of the upper section. The upper edges of the upper section include a central bight 66. The central bight is located closer to the intermediate section than to the upper edge of the back. The upper edges extend upwardly. The upper edges define an angle of 90 degrees plus or minus 10 percent. The system includes a generally horizontal plane between the intermediate section and the arm openings.

Provided last is a vest 14. The vest is worn over the upper section of the overall. The vest hides the upper section of the overall. The vest includes a front 68. The vest includes generally V-shaped upper edges 70. The vest includes selectively engageable buttons 72. The vest includes associated button holes 74. In this manner an opening is defined. Further in this manner the donning and removal of the vest is facilitated. The vest has a back 76. The vest has a U-shaped upper edge 78. The vest has straps 80. The straps are positionable over the shoulders of a wearer. The straps are formed with wide widths as extensions of the back rearwardly and as extensions of the front forwardly. The straps of the vest are between 30 percent and 100 percent wider than the straps of the overall at their highest regions. The vest are sized to cover the entire upper section of the overall and a portion of the intermediate section of the overall with the width of the straps of the vest entirely covering the straps of the overall. The vest extends downwardly to be located entirely below the horizontal plane. The bight of the overall is closer to the horizontal plane than to the upper edge of the back.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparel system consisting of:

an overall having a front and a back with sides there between, the overall having an upper section and a lower section with an intermediate section there between;

the upper section consisting of a bib front with utility pockets and V-shaped upper front edges terminating with front buttons, the upper section having a back with V-shaped upper back edges, the upper section having straps positionable between the front and back extending over the shoulders of the wearer, the straps consisting of slide buckles and being formed with narrow widths as extensions of the back rearwardly and with hooks forwardly adapted to separably couple with the front buttons for forming lateral arm openings for the arms of a wearer and for facilitating the donning and removal of the overall, the lateral arm openings consisting of selectively engageable side buttons with associated button holes for facilitating the donning and removal of the overall;

the lower section consisting of two laterally spaced leg parts below and a hips part above with pockets on the hip section;

the intermediate section consisting of a lower end formed as an integral extension of the lower section and an upper end integrally formed as an extension of the upper section, the intermediate section having side slits formed as continuations of the lateral arm openings of the upper section, the upper front edges of the upper section consisting of a central bight located closer to the intermediate section than to the upper back edges and with the upper front edges extending upwardly and defining an angle of 90 degrees plus or minus 10 percent;

the overall consisting of a generally horizontal plane between the intermediate section and the arm openings, the bight of the overall being closer to the horizontal plane than to the upper back edges; and a covering garment worn over the upper section of the overall and entirely hiding the upper section of the overall, the covering garment covering garment consisting of a front and generally V-shaped upper front covering garment edges and selectively engageable buttons with associated button holes defining an opening for facilitating the donning and removal of the covering garment, the covering garment having a back with a U-shaped upper back covering garment edge, the covering garment having straps positionable over the shoulders of a wearer, the straps being formed with wide widths as extensions of the back rearwardly and as extensions of the front forwardly, the straps of the covering garment being between 30 percent and 100 percent wider than the straps of the overall at their highest regions, the covering garment being sized to cover the entire upper section of the overall and a portion of the intermediate section of the overall with the width of the straps of the covering garment entirely covering the straps of the overall, the covering garment extending downwardly to be located entirely below the horizontal plane, the bight of the overall being closer to the horizontal plane than to the upper back covering garment edge.

* * * * *